US007623954B2

(12) United States Patent
Nakazawa et al.

(10) Patent No.: US 7,623,954 B2
(45) Date of Patent: Nov. 24, 2009

(54) AIR-FUEL RATIO CONTROL APPARATUS AND METHOD OF INTERNAL COMBUSTION ENGINE

(75) Inventors: Satoshi Nakazawa, Yokohama (JP); Hiroshi Katoh, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 310 days.

(21) Appl. No.: 11/717,256

(22) Filed: Mar. 13, 2007

(65) Prior Publication Data

US 2007/0215131 A1 Sep. 20, 2007

(30) Foreign Application Priority Data

Mar. 14, 2006 (JP) ..... 2006-068440

(51) Int. Cl.
*B60T 7/12* (2006.01)
*F02M 1/00* (2006.01)

(52) U.S. Cl. ..... 701/103; 123/434

(58) Field of Classification Search ..... 123/434, 123/680, 681, 696; 701/109, 101, 103, 114
See application file for complete search history.

(56) References Cited

U.S. PATENT DOCUMENTS 5,343,701 A * 9/1994 Douta et al. ..... 60/276
7,275,364 B2 * 10/2007 Tamura et al. ..... 60/285
2003/0033075 A1 * 2/2003 Yasui et al. ..... 701/109
2003/0066518 A1 * 4/2003 Katoh ..... 123/672
2006/0112942 A1 * 6/2006 Katoh ..... 123/681

FOREIGN PATENT DOCUMENTS

JP H09-317531 A 12/1997
JP 2003-90252 3/2003

OTHER PUBLICATIONS

English Abstract for JP-2003-90252.

* cited by examiner

*Primary Examiner*—John T Kwon
(74) *Attorney, Agent, or Firm*—Global IP Counselors, LLP

(57) ABSTRACT

An air-fuel ratio feedback control range is enlarged to improve exhaust purification performance and output stability. In one aspect, an air-fuel ratio control apparatus of an internal combustion engine comprises an air-fuel ratio sensor capable of detecting an air-fuel ratio across both lean and rich ranges with a theoretical air-fuel ratio interposed therebetween. Feedback control is performed so as to bring an actual air-fuel into a target air-fuel ratio at least in a predetermined operational range on the basis of a detected value of the air-fuel ratio sensor. Even in a range where the air-fuel ratio is made richer than the theoretical air-fuel ratio, the target air-fuel ratio is set to be richer, and the air-fuel ratio feedback control may still be executed.

5 Claims, 9 Drawing Sheets

AIR-FUEL RATIO CONTROL APPARATUS AND METHOD OF INTERNAL COMBUSTION ENGINE

CROSS-REFERENCE TO RELATED APPLICATIONS

This application claims priority from Japanese Patent Application Serial No. 2006-068440 filed Mar. 14, 2006 the entire contents of which are incorporated herein by reference.

TECHNICAL FIELD

An air-fuel ratio control apparatus of an internal combustion engine is disclosed, and more particularly an apparatus and technique for controlling an air-fuel ratio at high accuracy over a wider range of operation.

BACKGROUND

In an internal combustion engine including a purifying catalyst in an exhaust passage, feedback control of an air-fuel ratio is performed so as to maintain the air-fuel ratio in the vicinity of a theoretical air-fuel ratio where purification efficiency of the catalyst is high. Japanese Patent Application Laid-Open No. 10-288075(Patent Document 1) discloses an air-fuel ratio control apparatus that performs high-accuracy feedback control by using an air-fuel ratio sensor capable of detecting an air-fuel ratio over a wide range of operation.

However, although the apparatus described in Patent Document 1 performs the feedback control to a theoretical air-fuel ratio, the control is switched to a feedforward control in a rich air-fuel ratio range where a fuel injection amount is made that is larger than an amount equivalent to the theoretical air-fuel ratio at the time of acceleration or the like. This disadvantageously results in larger fluctuations with respect to a target value of the air-fuel ratio in the rich air-fuel ratio range, which causes fluctuations in output performance.

SUMMARY

An apparatus and technique is disclosed to prevent fluctuations in an air-fuel ratio even in a rich air-fuel ratio range and to assure stable output performance.

An air-fuel ratio control apparatus of an internal combustion engine comprises an air-fuel ratio sensor capable of detecting an air-fuel ratio across both lean and rich ranges with a theoretical air-fuel ratio interposed therebetween. The apparatus is used to perform feedback control so as to bring an actually air-fuel ratio into a target air-fuel ratio at least in a predetermined operational range on the basis of a detected value of the air-fuel ratio, the target air-fuel ratio is set to be richer, and the air-fuel ratio feedback control may still be executed.

Thus, even in the rich range, the air-fuel feedback control based on a detection signal from the air-fuel ratio sensor is performed, which suppresses fluctuations in the air-fuel ratio resulting in a stable output performance.

BRIEF DESCRIPTION OF THE DRAWINGS

While the claims are not limited to the illustrated embodiments, an appreciation of various aspects of the apparatus and methods is best gained through a discussion of various examples thereof. Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limiting or restricting to the precise form and configuration shown in the drawings and disclosed in the following detailed description. Exemplary embodiments of the present invention are described in detail by referring to the drawings as follows.

DETAILED DESCRIPTION

Figure 1:
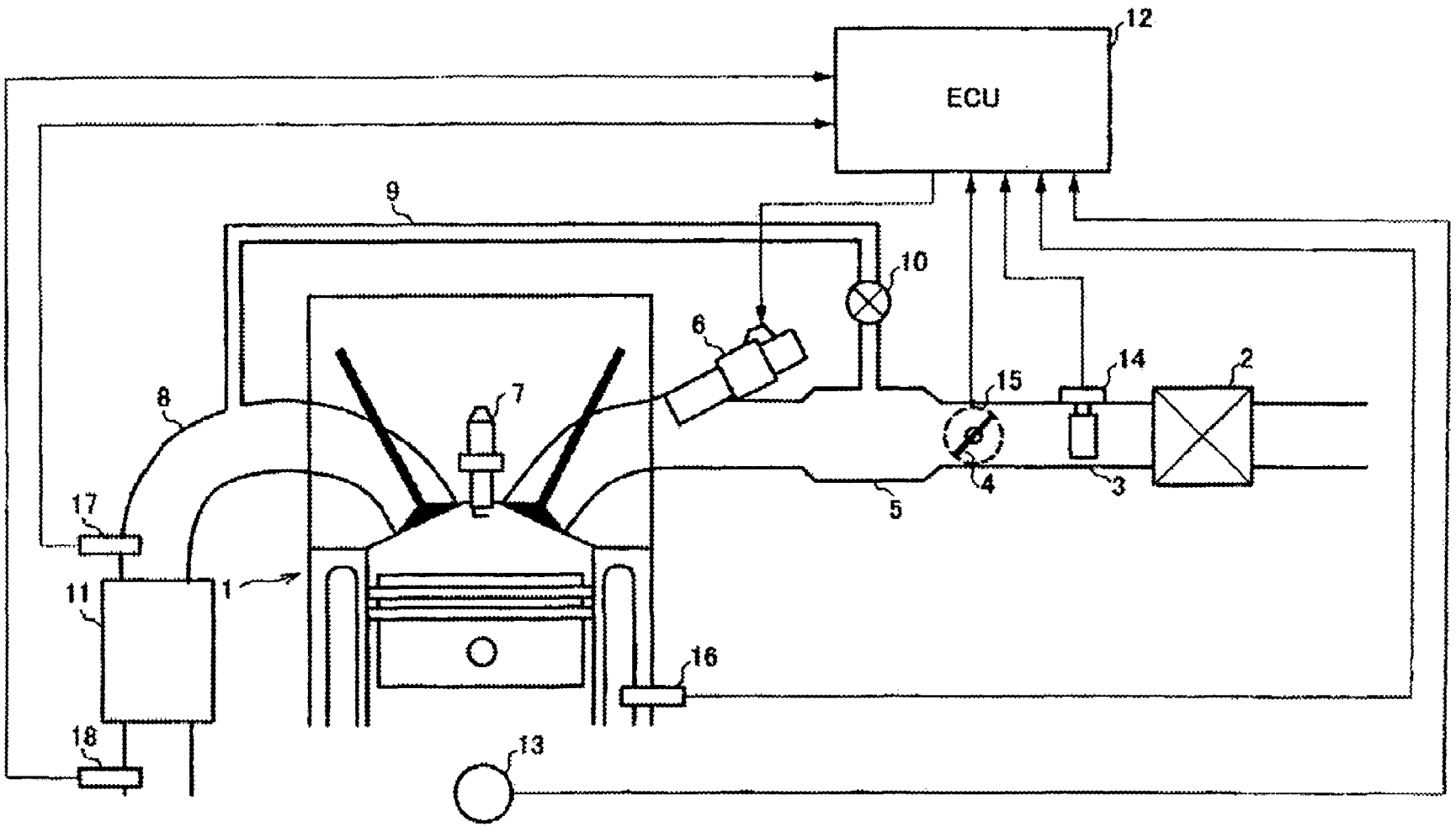
FIG. 1 is a system diagram of an air-fuel ratio control apparatus of an internal combustion engine.

FIG. 1 is a system diagram of an air-fuel ratio control apparatus of an engine (internal combustion engine).

Air is sucked from an air cleaner 2 through an intake duct 3, a throttle valve 4, and an intake manifold 5 into a combustion chamber of each cylinder of an engine 1. In each branch portion of the intake manifold 5, a fuel injection valve 6 is provided for each of the cylinders. However, the fuel injection valve 6 may be arranged so as to directly face the inside of the fuel chamber.

The fuel injection valve 6 is an electromagnetic fuel injection valve (injector) that opens by carrying current to a solenoid and closes by stopping current. More specifically, the fuel injection valve 6 opens by carrying current according to a drive pulse signal from an engine control unit (hereinafter, referred to as ECU) 12 described later, and injects and supplies a fuel, which has been compression-transported from a fuel pump (not shown) in the figure and has been adjusted to a predetermined pressure by a pressure regulator. Accordingly, the fuel injection amount is controlled by a pulse width of the drive pulse signal.

A spark plug 7 is provided is provided in each of the combustion chambers of the engine 1, by which air-fuel mixture is ignited and combusted by spark ignition.

Exhaust from each of the combustion chambers of the engine 1 exits through an exhaust manifold 8. Moreover, an EGR passage 9 is splits off from the exhaust manifold 8, by which a portion of the exhaust gas is made to flow back into the intake manifold 5 through an EGR valve 10.

Meanwhile, an exhaust purifying catalyst 11 is provided in the exhaust passage so as to be located, for example, immediately adjacent (shown under) the exhaust manifold 8.

The ECU 12 includes a processor such as a micro computer that includes a central processing unit (CPU), Read Only memory (ROM), Random Access Memory (RAM), analog/digital (A/D) converter, input/output interface, and the like. The ECU 12 receives input signals from various sensors and performs calculation processing as described later to control the operation of the fuel injection valve 6.

The aforementioned various sensors include a crank angle sensor 13, an air flow meter 14, a throttle sensor 15, a water temperature sensor 16, a wide-range type air-fuel ratio sensor 17, and an oxygen sensor 18. The crank angle sensor 13 is capable of detecting a crank angle and an engine rotational speed Ne from a crankshaft or camshaft rotation of the engine 1. The air flow meter 14 detects an intake air amount Qa inside of the intake duct 3. The throttle sensor 15 detects an opening TVO of the throttle valve 4 (including an idle switch which is turned ON at a full closed position of the throttle valve 4). The water temperature sensor 16 detects a cooling water temperature Tw of the engine 1. The air-fuel ratio sensor 17 is capable of detecting an exhaust air-fuel ratio linearly in a gathering portion of the exhaust manifold 8 upstream of the exhaust purifying catalyst 11. The oxygen sensor 18 detects a rich or lean state of the exhaust air-fuel ratio downstream of the exhaust purifying catalyst 11.

After engine startup, it is determined that the air-fuel ratio sensor 17 has been activated and so on, and then, the air fuel ratio feedback control is started. In this exemplary case the feedback control is performed so as to set a normal target air-fuel ratio to a theoretical air-fuel ratio, and additionally, even in a range where the fuel injection amount is increased to be richer than the theoretical air-fuel ratio, the air-fuel ratio feedback control is also performed. However, if the theoretical air-fuel ratio feedback control is performed similarly, a stable air-fuel ratio control may not performed due to disturbance or faulty control, and thus, the control is executed while increasing limitation.

Air-fuel ratio feedback control applicable to the present control may include sliding mode control and a Proportional-Integral-Derivative (PID) control, or a portion thereof, e.g., a PI control.

With the sliding mode control, a feedback control performed in the following manner exists. That is, with input of a plant (engine) set with an in-cylinder air-fuel ratio, and output thereof set as a detected air-fuel ratio, dynamic characteristics of the exhaust system of the engine and the air-fuel ratio sensor 17 are represented by a discrete-system quadratic transfer function. For the system represented by the transfer function, a state amount (air-fuel ratio) is made to follow a track inside of a state space by using the sliding mode control.

Figure 2:
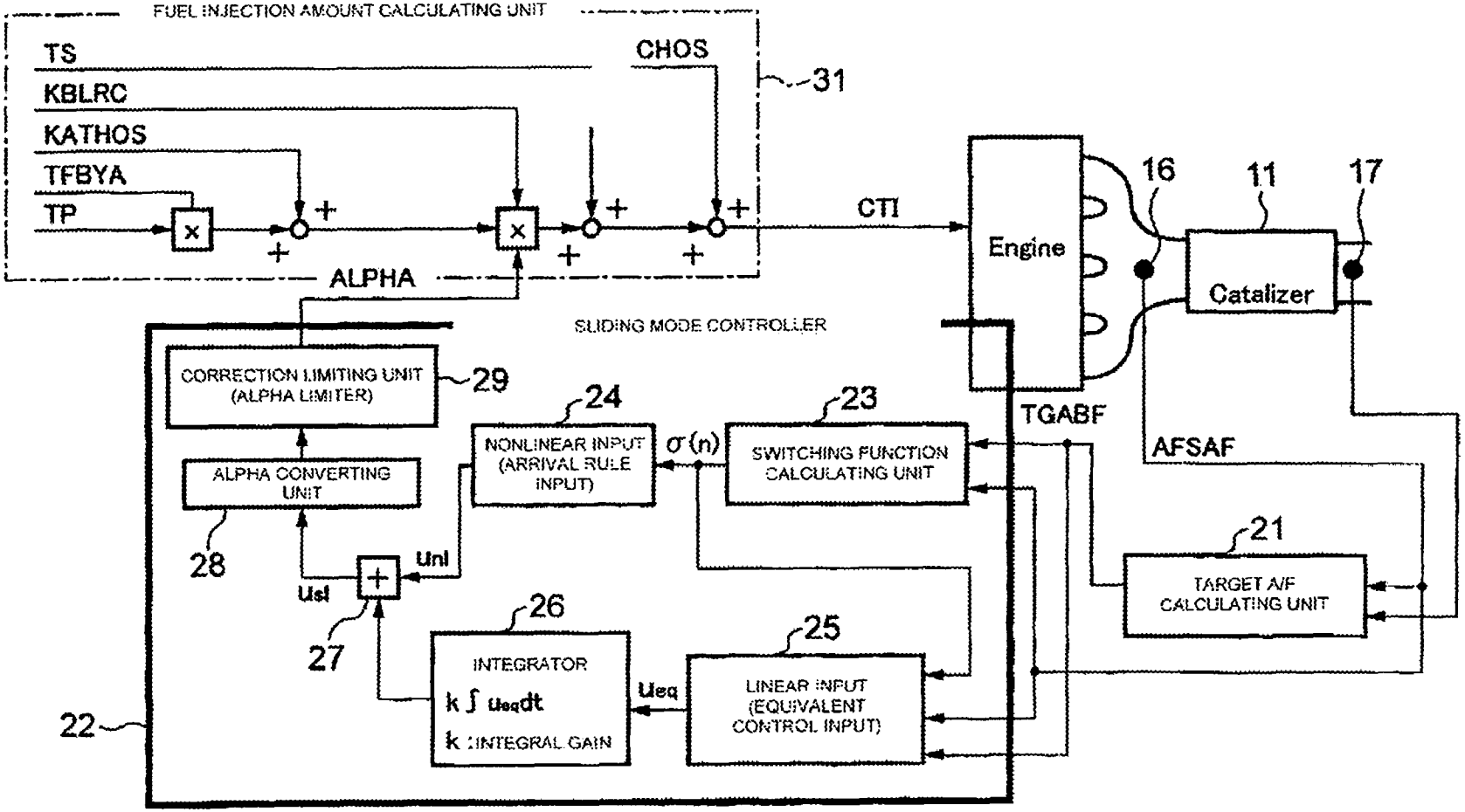
FIG. 2 is a block diagram in the case where feedback control is performed by using a sliding mode control.

FIG. 2 is a block diagram in the case where the feedback control is performed by the above-described sliding mode control.

In the sliding mode control, a sliding mode controller (sliding mode control unit) 22 is provided so as to obtain a target air-fuel ratio. The sliding mode controller 22 includes a switching function calculating unit 23, a nonlinear input calculating unit 24, a linear input calculating unit 25, an integrator 26, an adder 27, a converter 28, and a correction limiting unit 29. The outline of the control of the sliding mode controller 22 is as follows.

A state amount $\sigma(n)$ at a current time n is calculated in the switching function calculating unit 23 in accordance with a detected air-fuel ratio AFSAF and a target air-fuel ratio TGABF.

A nonlinear input unl is calculated in the nonlinear input calculating unit 24 on the basis of the state amount $\sigma(n)$.

Similarly, an equivalent control input ueq, which is a linear input is calculated in the linear input calculating unit 25 on the basis of the state amount $\sigma(n)$.

The calculated equivalent control input ueq is integrated by the integrator 26, an air-fuel ratio operating amount usl obtained by adding the nonlinear input unl to the integrated value is converted to an air-fuel ratio feedback correction coefficient ALPHA in the converter 28, and a correction amount is limited in the correction limiting unit 29.

A fuel injection amount calculating unit 31 applies the air-fuel feedback correction coefficient ALPHA as well as various other corrections to a basic injection pulse width TP to calculate a fuel injection pulse width CTI by the following formula.

The fuel injection valve 5 is intermittently driven through the use of the calculated fuel injection pulse width CTI. The fuel injection pulse width CTI is calculated by the following formula (1):

$$CTI=(TP\times TFBYA+KATHOS)\times(\mathrm{ALPHA}+KBLRC-1)+TS+CHOS \quad (1)$$

where TFBYA is a target equivalent ratio; KATHOS is a fuel feedforward correction value; ALPHA is an air-fuel ratio feedback correction coefficient; KBLRC is an air-fuel ratio learning value; TS is an invalid injection pulse width; and CHOS is a fuel feedforward correction value for each cylinder.

The feedback control to the theoretical air-fuel ratio, at which the target equivalent ratio TFBYA=1, is performed in the following manner. The control is performed by adjusting the target air-fuel ratio TGABF while estimating an oxygen storage amount in accordance with a detected value of the wide-range air-fuel ratio sensor 17 and a detected value of the oxygen sensor 18 such that the oxygen storage amount of the exhaust purifying catalyst 11 is maintained at a predetermined value at which a transformation efficiency of the catalyst is maximized.

Meanwhile, the feedback control in the rich air-fuel ratio range according to the present invention is performed as follows. Specifically, the feedback control is performed such that the actual air-fuel ratio AFSAF detected by the wide-range air-fuel ratio sensor 17 is converged on the rich target air-fuel ratio TGABF according to the target equivalent ratio TFBYA.

Furthermore, at the time of feedback control in the rich air-fuel ratio range, the limitation is made larger since effects by disturbance and error are increased as compared with the time of feedback control to the theoretic air-fuel ratio.

Figure 3:
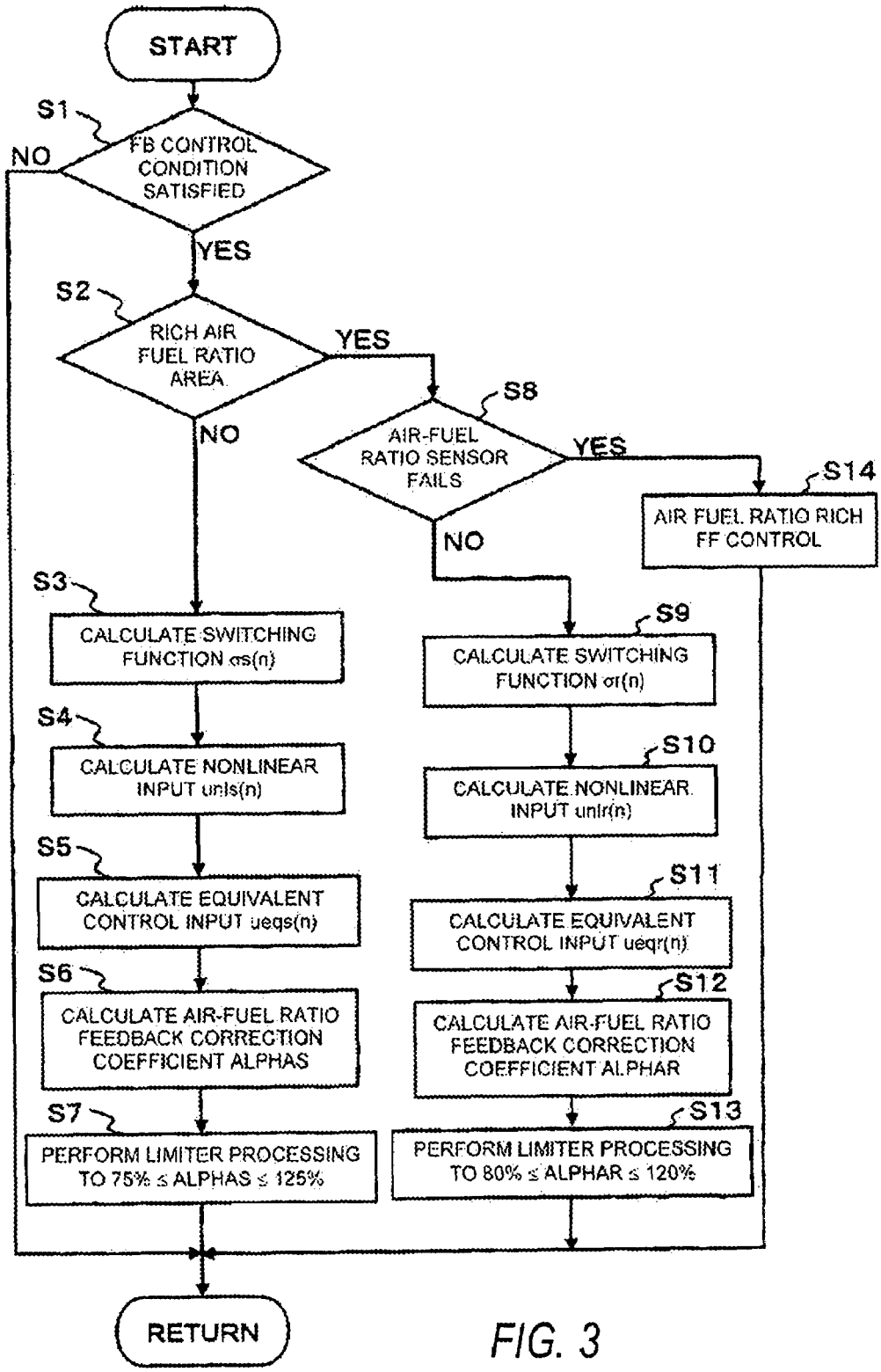
FIG. 3 is a flowchart of the sliding mode control.

FIG. 3 is a flowchart of an air-fuel ratio feedback control routine executed in the ECU 12 in a time-synchronous or rotation-synchronous manner.

In step S1, it is determined whether or not an air-fuel ratio feedback control condition is satisfied. More specifically, when a condition that the air-fuel ratio sensor 17 is activated at a water temperature of a predetermined value or higher, or the like is satisfied, it is determined that the air-fuel feedback control condition has been satisfied. In a conventional feedback control condition, the rich air-fuel ratio range where the fuel injection amount is increased is also an unsatisfactory condition. In the present case, however, the range is excluded from the unsatisfactory condition since the feedback control is also performed in the range.

If it is determined that the air-fuel ratio feedback control condition is satisfied in step S1, the process goes to step S2. In step S2, it is determined whether or not it is the rich air-fuel ratio range (fuel injection amount increasing range) where the target equivalent ratio TFBYA, which is set based on an engine operation state (rotational speed, load, water temperature), is more than 1.

If it is determined that it is not in the rich air-fuel ratio range in step S2, the theoretical air-fuel ratio feedback control where the target equivalent ratio TFBYA=1 is performed. In the present embodiment, the feedback control is performed by using the sliding mode control.

In step S3, a value of the switching function σs(n) is calculated by the following formula (2).

$$\sigma s(n)=S\times\{x_1(n)-\theta_1(n)\}+\{x_1(n)-x_1(n-1)\} \quad (2)$$

In the formula, $x_1(n)$ is a state amount of the control plant (engine), and more specifically, the air-fuel ratio AFSAF detected by the air-fuel ratio sensor 17. $\theta_1(n)$ is a target value of the state amount of $x_1(n)$, that is, the target air-fuel ratio TGABF. The right side first term in the above formula indicates a difference between the state amount $x_1(n)$ and its target value $\theta_1(n)$, and the second term indicates a differential value of the state amount $x_1(n)$(change amount per control cycle). Accordingly, setting σ(n)=0 means setting the difference to zero and the differential value to zero. Additionally, setting the difference to zero means reaching the target value, and setting the differential value to zero means resting at the position of the target value.

Next, in step S4, a nonlinear input unls(n) is calculated by the following formula (3).

$$unls(n)=-\eta\times\sigma(n)/(|\sigma(n)|+\delta) \quad (3)$$

where η is a nonlinear gain; and δ(>0) is a smoothing coefficient.

Subsequently, in step S5, an equivalent control input ueqs (n) is calculated by the following formula (4):

$$ueqs(n)=(b_0+b_1)\times[a_1x_1(n)+a_0x_2(n)-(a_0+a_1)\times\theta_1(n)+\{x_1(n)-\theta_1(n)\}/(S+1)] \quad (4)$$

where $a_0$, $a_1$, $b_0$, and $b_1$ are differential coefficients.

In step S6, the air-fuel ratio feedback correction coefficient ALPHA is calculated. It is outlined as follows (for details, refer to Japanese Patent Application Laid-Open No. 2003-90252, which is incorporated herein by reference in its entirety). That is, the equivalent control input ueq is integrated by the integrator 26, and the nonlinear input unl is added to the integrated value to calculate the air-fuel operation amount usl. Then, the air-fuel ratio feedback correction coefficient ALPHAS is calculated by the following formula (5):

$$\text{ALPHAS}=CYLAF/\{CYLAF+usl(n)\}\times100 \quad (5)$$

where CYLAF is a cylinder intake air-fuel ratio.

The cylinder intake air-fuel ratio CYLAF is derived from the following formula 6.

$$CYLAF=14.7\times TP/\{TP\times TFBYA\times(\text{ALPHA}+KBLRC-1)\} \quad (6)$$

In step S7, the aforementioned ALPHAS is limited. More specifically, a lower limiter ALPMINAS is set to 75% and an upper limiter ALPMAXAS is set to 125%. If ALPHAS calculated in step S6 is less than the lower limiter ALPMINAS, ALPHAS=75% is set, while if the ALPHAS exceeds the upper limiter ALPMAXAS, ALPHAS=125% is set, and thus, the ALPHAS is limited to a range of 75%≦ALPHAS≦125%.

On the other hand, if in step S2, it is determined that it is in the rich air-fuel ratio range, then the presence or absence of failure in the air-fuel ratio sensor 17 is determined in step S8.

If it is determined that the air-fuel ratio sensor 17 does not fail, the process goes to step S9 and later to perform the rich air-fuel ratio feedback control.

In step S9, a value of the switching function σr(n) is found. The switching function σr(n) is calculated by the following formula (7), in which a switching function gain S is multiplied by an inclination correction coefficient SLNTGN (<1) to reduce the gain.

$$\sigma r(n)=SLNTGN\times S\times\{x_1(n)-\theta_1(n)\}+\{x_1(n)-x_1(n-1)\} \quad (7)$$

In this case, while the target air-fuel ratio TGABF represented by $\theta_1(n)$ is calculated from the target equivalent ratio TFBYA as described before, a target equivalent ratio TFBYAR in the rich air-fuel ratio range is set by selecting a larger one of equivalent ratios TFBYA1 and TFBYA2 set in the two methods in accordance with the water temperature and the like, as represented by the following formula (8).

$$TFBYAR=\text{Max}(TFBYA1,TFBYA2) \quad (8)$$

Next, in step S10, a nonlinear input unlr(n) is calculated by the following formula (9) as in the theoretical air-fuel ratio control.

$$unlr(n)=-\eta\times\sigma(n)/(|\sigma(n)|+\delta) \quad (9)$$

Subsequently, in step S11, an equivalent control input ueqr (n) to which the inclination correction SLNTGN is applied is calculated by the following formula (10).

$$ueqr(n)=(b_0+b_1)\times[a_1x_1(n)+a_0x_2(n)-(a_0+a_1)\times\theta_1(n)+\{x_1(n)-\theta_1\}/(SLNTGN\times S+1)] \quad (10)$$

In step S12, an air-fuel ratio feedback correction coefficient ALPHAR is calculated by the following formula (11) as in the theoretical air-fuel ratio control.

$$\text{ALPHAR}=CYLAF/\{CYLAF+usl(n)\}\times100 \quad (11)$$

In step S13, the aforementioned ALPHAR is limited.

Here, at the time of the rich air-fuel ratio feedback control, a lower limiter ALPMINAR is set to 80% and an upper limiter ALPMAXAR is set to 120%. If ALPHAR calculated in step S11 is less than the lower limiter ALPMINAR, ALPHAR=80% is set, while if the ALPHAR exceeds the upper limiter ALPMAXAR, ALPHAR=120% is set, and thus, the ALPHAR is limited to a range of 80%≦ALPHAR≦120%.

Moreover, if it is determined that the air-fuel ratio sensor 17 fails in step S8, the process goes to step S14. In step S14, as represented by the following formula (12), the air-fuel ratio rich control by the feedforward control, in which the air-fuel ratio feedback correction coefficient ALPHA is fixed at 100%, is performed on the basis of a target equivalent ratio $\text{TFBYAR}_{FS}$ obtained by further making richer the target equivalent ratio $\text{TRFBYAR}_{FS}$ set in the normal rich air-fuel ratio range by a factor of KMRMUL (>1).

$$TFBYAR_{FS}=KMRMUL\times\text{Max}(TFBYA1,\ TFBYA2) \quad (12)$$

Figure 5B:
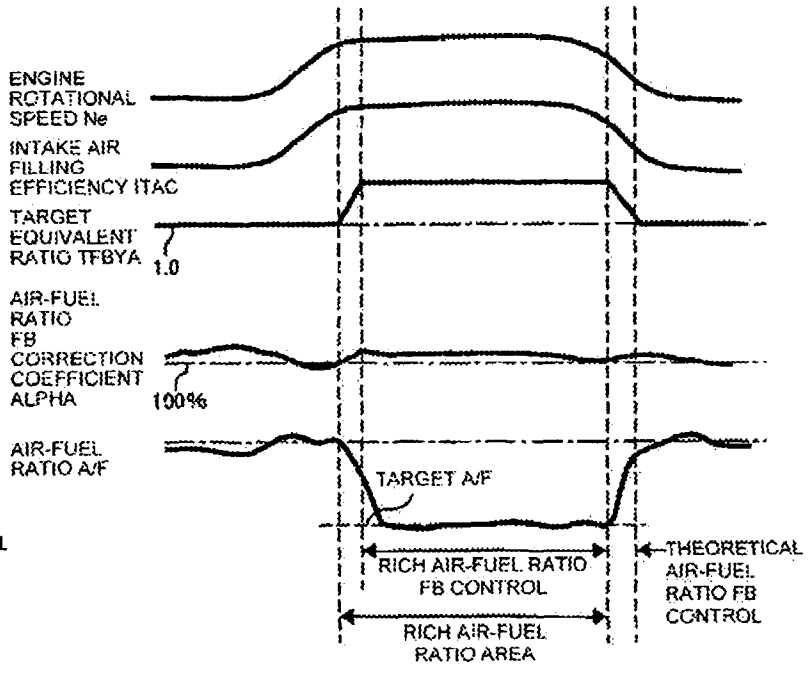
FIGS. 5A and 5B are timing charts for explaining a first effect of the control.
Figure 5A:
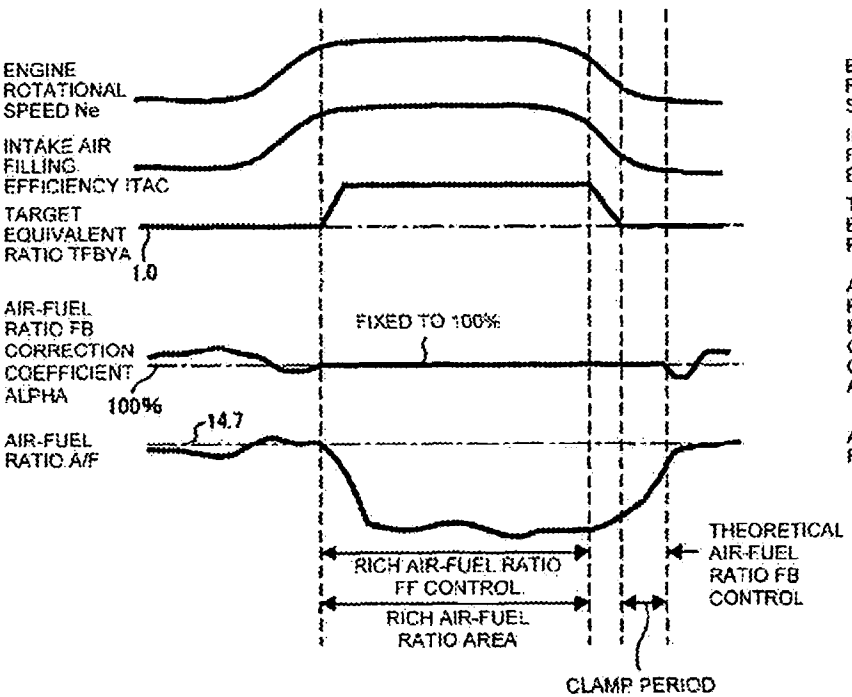

As described above, by executing the feedback control based on the detected value of the air-fuel ratio sensor in the rich air-fuel ratio range, favorable exhaust purification performance can be maintained, and stable output performance can be assured as shown in FIG. 5B in comparison with a case where the feedforward control is performed as shown in FIG. 5A.

Moreover, as for the switching to the theoretical air-fuel ratio feedback control, the rich air-fuel ratio control is performed by the feedforward control. In this case, a predetermined clamp period for fixing the air-fuel ratio feedback correction coefficient ALPHA to 100% is required for stability even after setting of target equivalent ratio=1, which delays the feedback control start. In contrast, in the case where of the rich air-fuel ratio feedback control, the theoretical air-fuel ratio feedback control can be started when the target equivalent ratio=1 is satisfied, which can further improve fuel consumption and exhaust purification performance.

Figure 4:
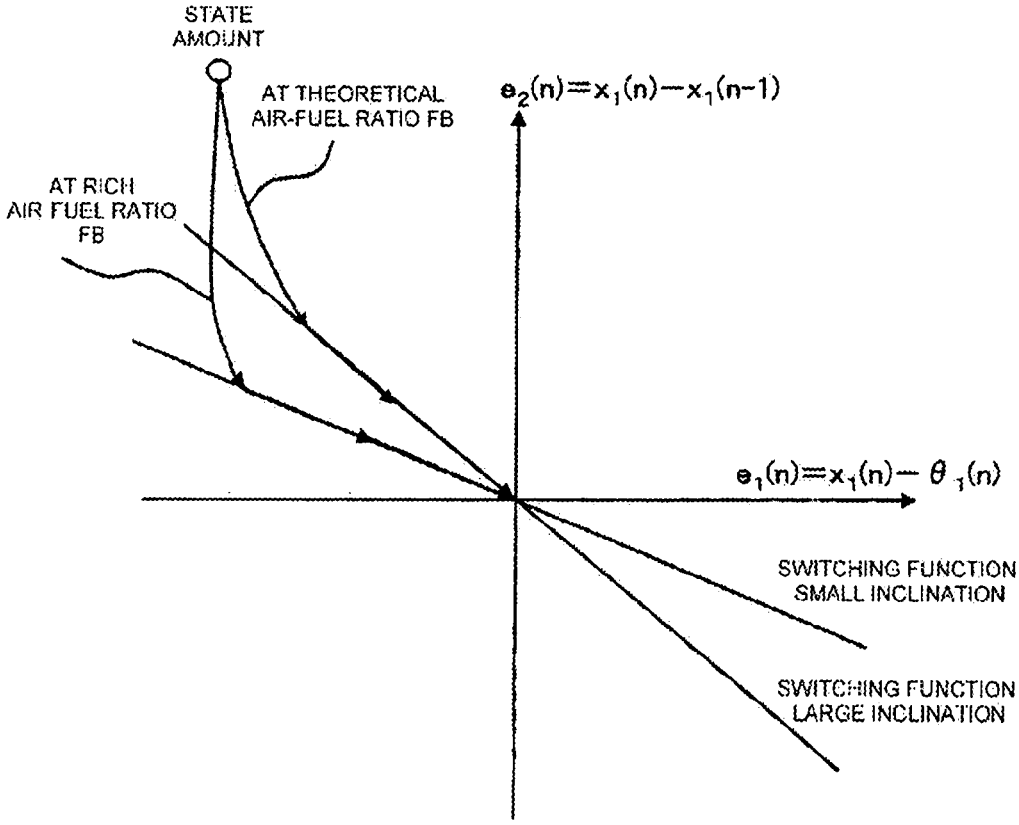
FIG. 4 is a showing motions of the sliding mode control on a phase plane.

Moreover, at the time of the feedback control in the rich air-fuel ratio range, the gain of the switching function σ(=SLNTGN×S) is set to a smaller value than the gain (=S) at the time of the theoretical air-fuel ratio feedback control to thereby reduce the inclination, as shown in FIG. 4.

Figure 6:
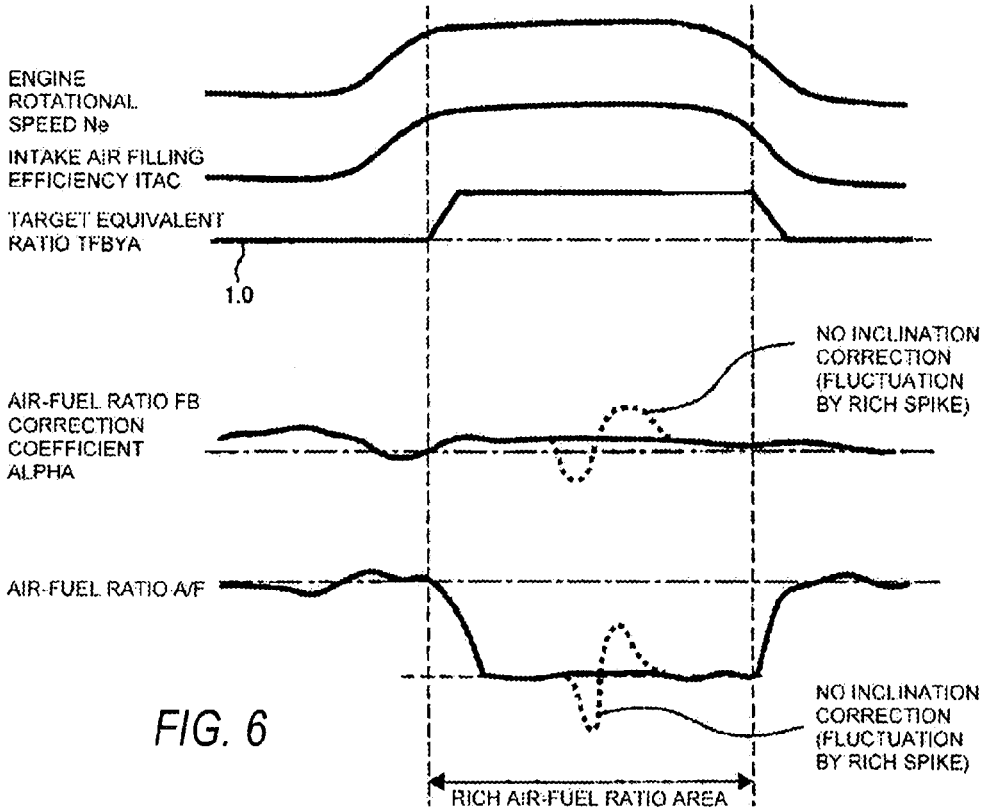
FIG. 6 is a timing chart for explaining a second effect of the control.

As shown in FIG. 6, this can prevent overcorrection caused by strengthening the limitation even when spike disturbances are added more than assumed. Accordingly, this can suppress the air-fuel ratio exceeding the lean limit, which can prevent an accidental fire.

Moreover, at the time of normal theoretical air-fuel ratio feedback control, as high of a response performance as ever can be maintained without applying reduction correction to the gain of the switching function.

Furthermore, changing the inclination of the switching function can reduce a feedback speed even when the original setting of the nonlinear gain and the integral gain are diverted, and, the integration is not stopped. As a consequence, even in the case where a large disturbance is constantly added, it can be absorbed.

Moreover, the acceptable change range of the air-fuel ratio feedback correction coefficient ALPHA is made narrower by making the limitation by the limiter larger at the time of rich air-fuel ratio control than that at the time of the theoretical air-fuel ratio control, which can also prevent the overcorrection by faulty feedback control.

Figure 7B:
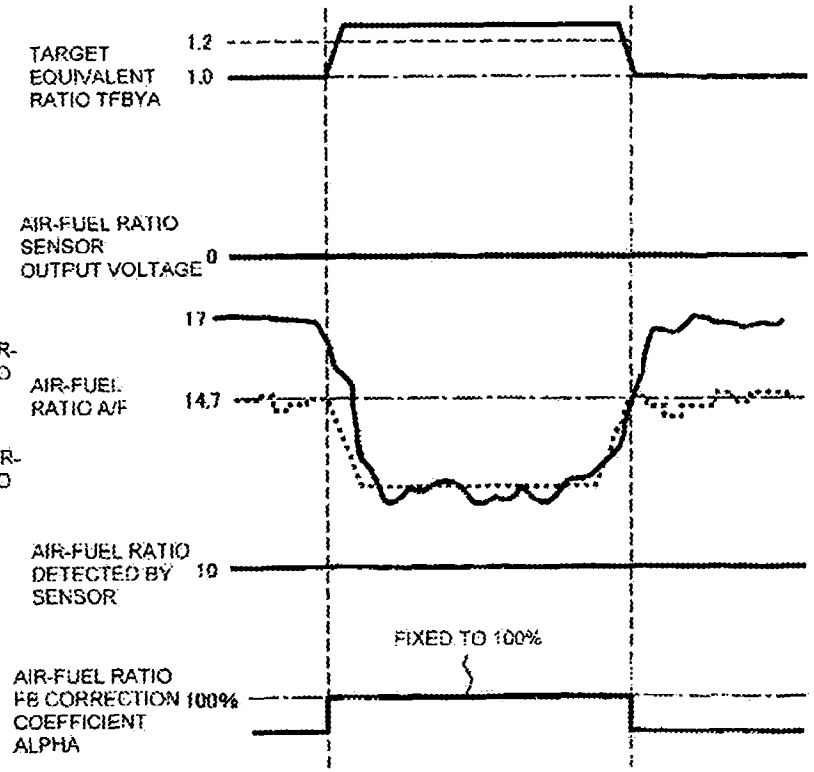
FIGS. 7A and 7B are timing charts for explaining a third effect of the control.
Figure 7A:
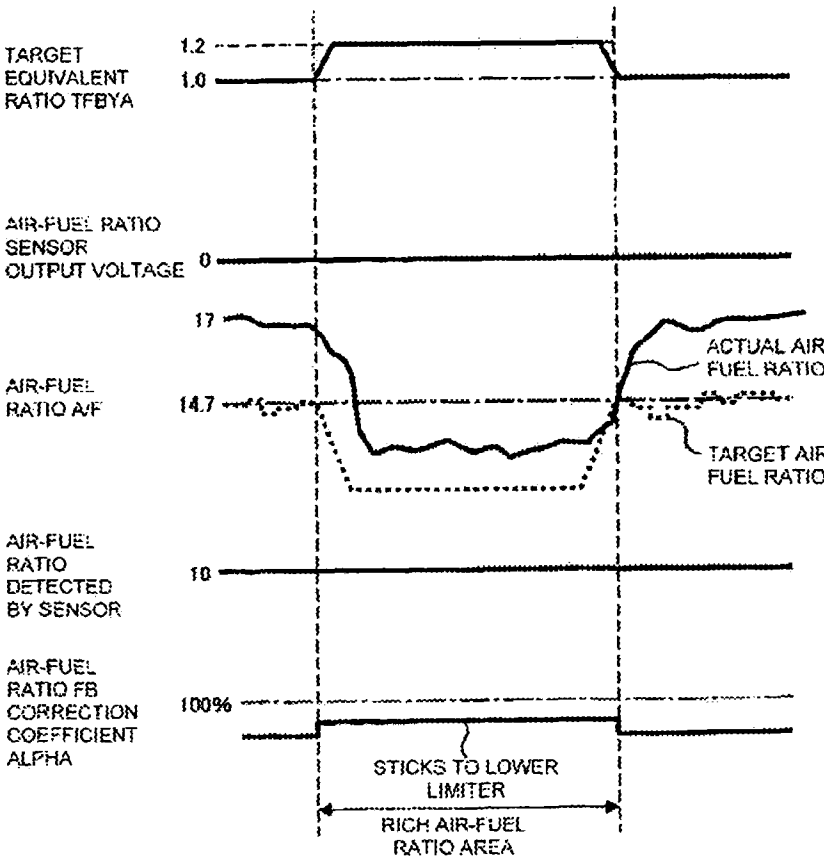

Furthermore, at the time of failure in the air-fuel ratio sensor, the feedback control is stopped to thereby perform the feedforward control to the rich air-fuel ratio obtained by being further made richer than the normal rich air-fuel ratio. Consequently, the air-fuel ratio is made rich enough to address fluctuations as shown in FIG. 7B in comparison with the case where the feedback control is continued as shown in FIG. 7A. This prevents the air-fuel ratio from being made leaner by a faulty feedback control.

Figure 8:
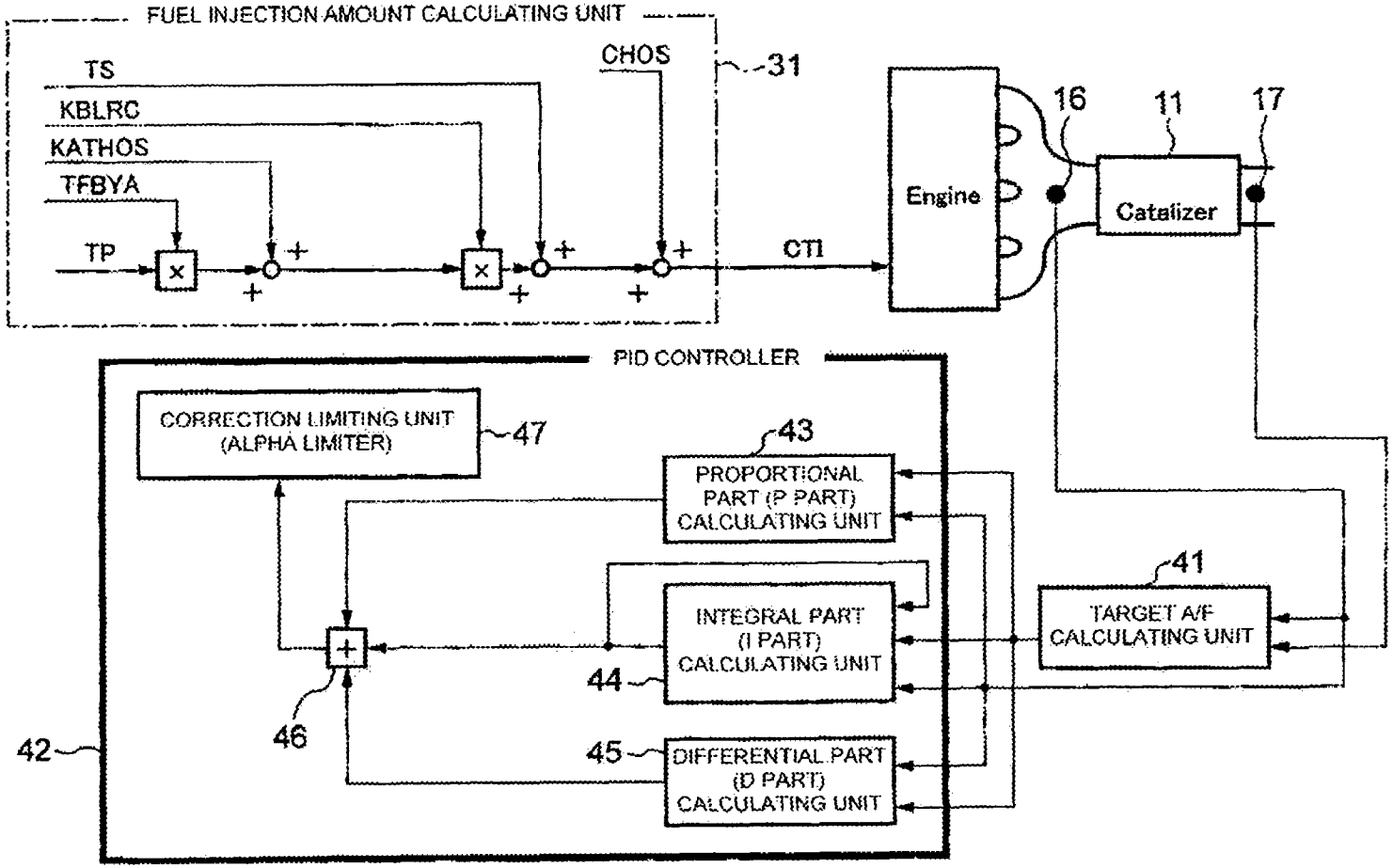
FIG. 8 is a block diagram in the case where the feedback control is performed by using PID control.

Subsequently, a case where the feedback control is performed by using PID control will be described. FIG. 8 is a block diagram in the case where the feedback control is performed by using the PID control.

In this case, a PDI controller (PDI control unit) 42 is provided such that the target air-fuel ratio is obtained at the time of the air-fuel ratio feedback control. The PID controller 42 includes a proportional part (P part) correction amount calculating unit 43, an integral part (I part) correction amount calculating unit 44, a differential part (D part) correction amount calculating unit 45, an adder 46, and a correction limiting unit 47.

The PDI controller 42 calculates a P part correction amount, an I part correction amount and a D part correction amount on the basis of the detected air-fuel ratio AFSAF and the target air-fuel ratio TGABF. The respective correction amounts are added to calculate the air-fuel ratio feedback correction coefficient ALPHA. After the correction amount is limited by the correction limiting unit 47, a fuel injection pulse width CTI is calculated in the fuel injection amount calculating unit 31, as in the sliding mode control. The fuel injection valve 5 is intermittently driven through the use of the calculated fuel injection pulse width CTI.

Based on the foregoing, more specific control contents will be described.

Figure 9:
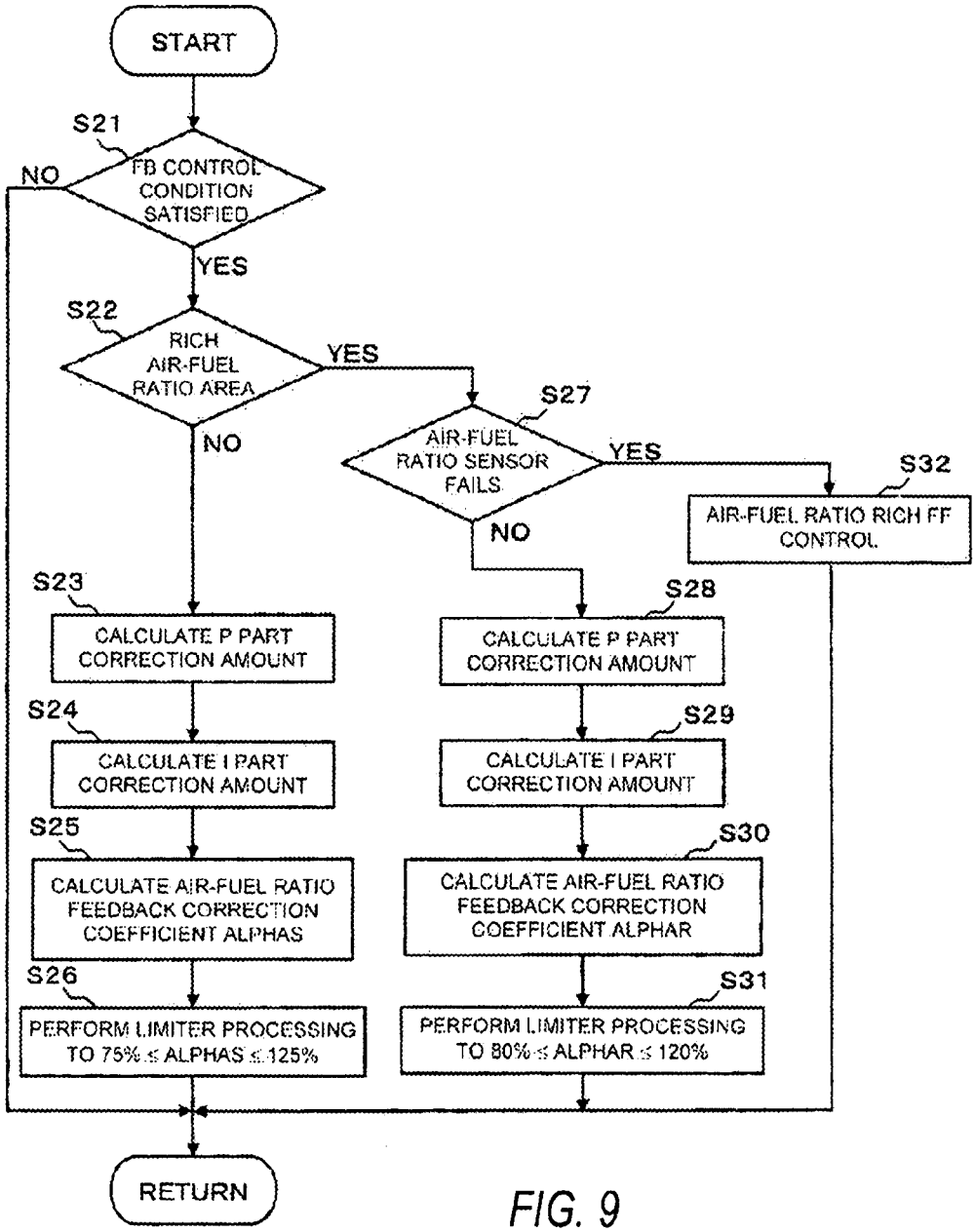
FIG. 9 is flowchart in which a feedback gain of the PID control is calculated.

FIG. 9 is a flowchart of the calculation if the feedback gain (air-fuel ratio feedback correction coefficient ALPHA).

Steps S21 and S22 are similar to those of the sliding mode control (steps S1 and S2), descriptions of which are omitted.

If in step S22, it is determined that it is the feedback control range with the theoretical air-fuel ratio, the process goes to step S23 and following. That is, the proportional part (P part) correction amount is calculated (step S23), the integral part (I part) correction amount is calculated (step S24), and then, both are added to calculate the air-fuel ratio feedback correction coefficient ALPHAS (step S25). The above-described control is the same as normal PID control.

In step S26, the calculated air-fuel ratio feedback correction coefficient ALPHAS is subject to the limiter to be limited to the range 75%≦ALPHAS≦125% as in the sliding mode control.

On the other hand, if in step S22, it is determined that it is the feedback control range with the rich air-fuel ratio, then the presence or absence of failure in the air-fuel ratio sensor 17 is determined as in the sliding mode control in step S27. If it is determined that the air-fuel ratio sensor 17 does not fail, the process goes to step S28 and later.

In step S28, a proportional part (P part) correction amount TALPGAI is calculated.

Here, the proportional part correction amount TALPGAI, which is referred to in a P part gain table, is limited by the limiter so as not to exceed the predetermined value, and the limiter is set to a smaller value than that at the time of the theoretical air-fuel ratio feedback control to thereby strengthen the limitation. However, only the limiter of the proportional part correction amount in the direction of reducing the fuel injection amount may be set to the smaller value, while the limiter of the proportional part correction amount in the direction of increasing the fuel injection amount may be set as in the theoretical air-fuel ratio control. In step S29, the integral gain is found by the following formula.

$$\text{Integral gain}=TALIGAI\times AFIGDWN\#$$

where TALIGAI is an I part gain table reference value.

AFIGDWN is a gain correction amount and a constant number of less than 1 (for example, AFIGDWN#=0.5). By multiplying TALIGAI by the gain correction coefficient AFIGDWN# the integral gain is thereby reduced.

In step S30, the proportional part correction amount and the integral part correction amount are added to calculate the air-fuel ratio feedback correction coefficient ALPHAR.

In step S31, ALPHAR is subjected to the stronger limit processing than that at the time of theoretical air-fuel ratio control as in the sliding mode control to limit it to the range of 80%≦ALPHAR≦120%.

Moreover, if in step S27, it is determined that the air-fuel ratio sensor 17 fails, the process goes to step S32. In step S32, the air-fuel ratio rich control by the feedforward control, in which the air-fuel ratio is made richer than that in the normal rich air-fuel ratio range, is performed as in the sliding mode control.

By performing the above-described procedure, as in the sliding mode control, the limitation is applied when disturbances such as rich spike more than assumed are added. Therefore, overcorrection does not occur, which can prevent an accidental fire.

Moreover, the integration is not stopped. For this reason, even when large disturbances are constantly added, they can be absorbed, which is also similar to the sliding mode control.

The preceding description has been presented only to illustrate and describe exemplary embodiments of the claimed invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed:

1. An air-fuel ratio control apparatus of an internal combustion engine, comprising:

an air-fuel ratio sensor capable of detecting a stoichiometric air-fuel ratio and provided in an exhaust gas passage of an engine; and a controller selectively performing an air-fuel ratio feedback control to bring an air-fuel ratio of the engine toward a target air-fuel ratio on the basis of an output from the air-fuel ratio sensor, in which the target air-fuel ratio is a rich air-fuel ratio when the engine is operated in a rich operational region where fuel supply to the engine is increased, the air-fuel ratio feedback control being performed with a feedback coefficient for selectively bringing the air-fuel ratio toward the target air-fuel ratio and performed by selectively limiting the feedback coefficient at a limit value, in which the limit value used in the rich operational region is determined such that the feedback coefficient is generally limited as compared to a limit value used in an operational region other than the rich operational region.

2. The air-fuel ratio control apparatus of an internal combustion engine according to claim 1, wherein the air-fuel ratio control is performed with a sliding mode control, an inclination of a transfer function for the sliding mode control used in the rich operational region is smaller as compared to that used in the operational region other than the rich operational region.

3. The air-fuel ratio control apparatus of an internal combustion engine according to claim 1, wherein the air-fuel ratio control is performed with at least one of a Proportional Integral (PI) control and a Proportional Integral Derivative (PID) control, a proportional portion used in the rich operational region being smaller as compared to that used in the operational region other than the rich operational region.

4. The air-fuel ratio control apparatus of an internal combustion engine according to claim 1, wherein the air-fuel ratio control is performed with at least one of a Proportional Integral (PI) control and a Proportional Integral Derivative (PID) control, an integral portion used in the rich operational region being smaller as compared to that used in the operational region other than the rich operational region.

5. An air-fuel ratio control method of an internal combustion engine having an air-fuel ratio sensor capable of detecting a stoichiometric air-fuel ratio in an exhaust gas of the engine, comprising:

determining whether an engine is operated in a rich operational region where fuel supply to the engine is increased, and performing an air-fuel ratio feedback control for bringing an air-fuel ratio of the engine toward a target air-fuel ratio on the basis of an output from the air-fuel ratio sensor, in which the target air-fuel ratio is a rich air-fuel ratio when the engine is in the rich operational region, the air-fuel ratio feedback control being performed with a feedback coefficient selectively bringing the air-fuel ratio toward the target air-fuel ratio and performed by selectively limiting the feedback coefficient at a limit value, the limit value used in the rich operational region being determined such that the feedback coefficient is generally limited as compared to a limit value used in an operational region other than the rich operational region.

* * * * *